United States Patent [19]

Tucker

[11] 4,436,353

[45] Mar. 13, 1984

[54] PORTABLE STORAGE DEVICE AND TABLE

[76] Inventor: Myron B. Tucker, 6600 Hill Rd., Boise, Id. 83703

[21] Appl. No.: 290,610

[22] Filed: Aug. 6, 1981

[51] Int. Cl.[3] ..... A47B 85/00

[52] U.S. Cl. ..... 312/241; 312/140.2; 312/270; 312/258; 312/282; 190/11

[58] Field of Search ..... 190/11, 12 R; 312/233, 312/240, 241, 258, 270, 282, DIG. 33, 140.2

[56] References Cited

U.S. PATENT DOCUMENTS

| | | | |
|---|---|---|---|
| 541,504 | 6/1895 | Roberts | 312/258 X |
| 775,731 | 11/1904 | McCabe, Jr. | 190/11 |
| 1,292,468 | 1/1919 | Hominuke | 190/11 |
| 2,122,969 | 2/1938 | Whitcomb | 312/282 X |
| 2,351,610 | 6/1944 | Hamberg | 312/282 X |
| 3,201,186 | 8/1965 | Noonan et al. | 312/258 X |
| 3,558,203 | 1/1971 | Alter | 312/258 X |

FOREIGN PATENT DOCUMENTS

| | | | |
|---|---|---|---|
| 60985 | 1/1913 | Austria | 312/282 |

*Primary Examiner*—William E. Lyddane
*Assistant Examiner*—Joseph Falk
*Attorney, Agent, or Firm*—Fitch, Even, Tabin & Flannery

[57] ABSTRACT

A portable storage device and table for outdoors activity which unfolds from a trunk-like container into a table, having a front shelf face which foldably lifts from the container providing support for the table surface, and the trunk-like base providing a storage receptacle.

3 Claims, 7 Drawing Figures

PORTABLE STORAGE DEVICE AND TABLE

This invention relates to a foldable table and packing container. More particularly, this invention relates to a camp packing trunk for enclosing camping equipment such as food, cooking utensils, and clothes wherein the trunk opens and folds into a support, table, and storage receptacle for cooking food, serving meals and other camping needs, or other uses where a portable storage and support may be used.

Camping and outdoors recreational activity are enjoyed by many people, but often this outdoor activity is in areas where storage facilities and tables are not available. Motor vehicles, tents, and campers provide good sleeping facilities, but often they do not provide a portable table and storage area convenient for storage, preparation and serving facilities for food. According to the invention, upon unfolding, a hexahedron or trunk-like container can be opened into a table or support with the trunk-like base providing a storage receptacle. A shelf face within the container provides storage compartments. The shelf face foldably lifts from the container to thereby provide shelves for food, utensils, or other camping supplies, as well as support braces for a table top. The table top folds from the container and from leaves to provide an open unfolded table top, substantially larger than any side of the hexahedron container.

An object of the invention is to provide a portable storage receptacle which can be folded into a table having a base which provides shelving and storage.

Another object of the invention is to provide a trunk-like device for storing and transporting food while camping, such device unfolding from leaves into a table top for preparing and serving food, with bracing for the table top unfolding from the trunk, the device also providing shelves for storage of camping supplies. These and other objects of the invention are more particularly set forth in the following detailed description and accompanying drawings of which:

Figure 1:
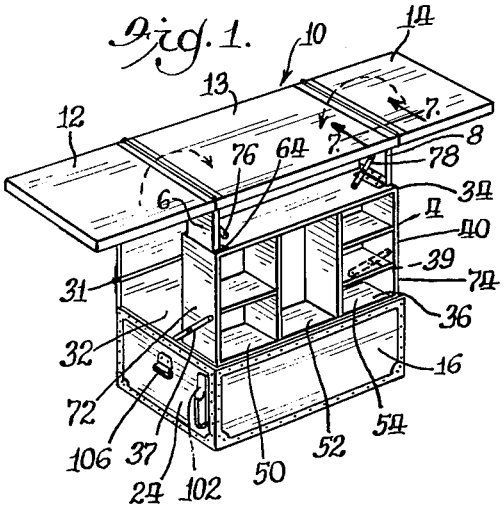
FIG. 1 is a perspective view of the folding table and storage device in its unfolded position.

Referring now in detail to the drawings, the present invention will now be more particularly described with respect to a specific embodiment of a trunk-like or hexahedron container 2 containing a foldable shelf face 4 having wing braces 6 and 8, and a foldable table top 10 having a central section 13 and side leaves 12 and 14 hinged thereon.

Figure 2:
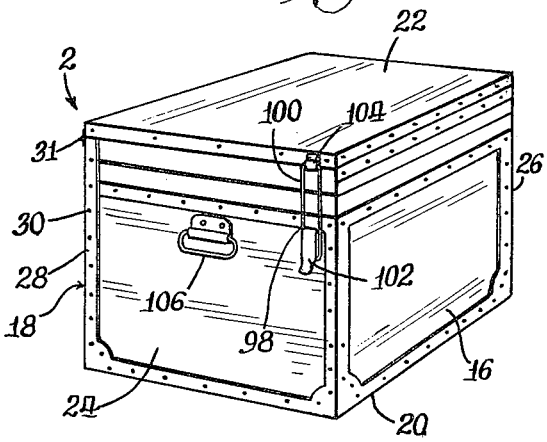
FIG. 2 is a perspective view of the folding table and storage device in the closed position.

As seen in FIG. 2, the hexahedron container has a front panel 16, back panel 18, bottom panel 20, top panel 22, and side panels 24 and 26. In its preferred form the container is trunk-like with the front, side, top, and bottom panels being rectangular. When the device is in closed position, the back panel is perpendicular to the side, bottom and top panels and parallel to the opposing front panel. The bottom panel is perpendicular to the side and front panels and parallel to the top panel. The opposing side panels are parallel and each opposing side panel is perpendicular to the adjacent front, back, top, and bottom panels. Adjacent front, bottom, back and side panels are held together by a strips 28 through which fasteners, such as rivots 30, extend into the respective adjacent panels, as is known. Preferrably the strips are rubber, metal or other tough material. The top panel is hingedly connected to the top edge of the back panel with a piano hinge 31. The height of the back panel exceeds that of the front and side panels such that the back panel has a back wing 32. The back wing permits the leaves and the table top to be folded under the top panel, and permits the top panel to be closed and locked into position parallel to the bottom panel, as will be hereinafter described.

The shelf face 4 is rectangular and includes a top cross member 34, bottom cross member 36 which is parallel to cross member 34, and parallel side members 38 and 40 which are adjacent and perpendicular to the bottom and top cross members.

The shelf face is hingedly connected with a piano hinge 43 to the top edge 42 of the front panel 16 at the front face of the bottom cross member 36. In the unfolded position, folding knee braces 37 and 39 hold the shelf face in a plane perpendicular to the bottom panel 20 when the container is in an open position. In the folded position the shelf face is folded inward the container and is held perpendicular to the front panel by the knee braces 37, 39 in the folded position. Knee brace 37 extends from an intermediate position on the upper portion of the inner surface of side panel 24 to an intermediate point on the outer surface 72 of side member 38. Knee brace 39 extends from an intermediate point on the upper portion of the inner surface of side panel 26 to an intermediate point on the outer surface 74 of side member 40. When knee braces 37 and 39 are broken or folded, shelf face 4 may be folded into the container on hinge 43 to lie in a plane parallel to bottom and top panels 20 and 22, and perpendicular to the front panel.

Figure 4:
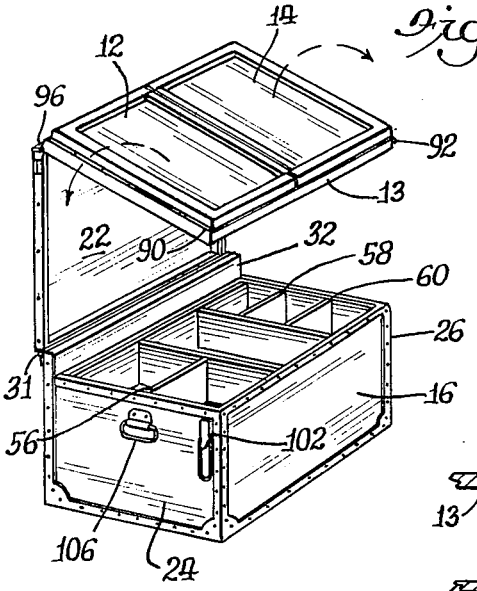
FIG. 4 is a diagrammatic view of the folding table and storage device being opened.

Preferably the shelf face has a back shelf panel 44 on the rear of the shelf face and perpendicular to the cross and side members of the shelf face. As seen in FIG. 4, the back shelf panel lies in a plane spaced from and parallel to the bottom panel 20 when the container is in the closed position, creating a storage chamber between the bottom panel 20 and overlying back shelf panel 44. As seen in FIG. 1, the back shelf panel lies in a plane spaced from and parallel to the front panel 16 when the container is in the open position.

Dividers 46 and 48, which extend between the top and bottom cross members and are perpendicular to each shelf panel 44, divide the shelf face into three storage areas, side storage area 50, central storage area 52, and side storage area 54. Side storage area 50 is equally divided into two storage units by shelf 56 which is parallel to the top and bottom cross members and perpendicular to side member 38. Side storage area 54 is equally divided into three storage units by shelves 58 and 60 which are parallel to the top and bottom cross members and perpendicular to side member 40.

Figure 7:
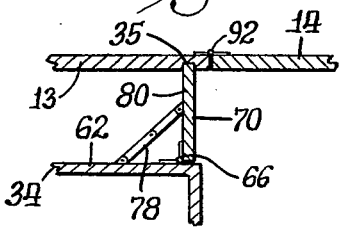
FIG. 7 is a cross sectional view along the line 7—7 in FIG. 1.

Wing braces 6 and 8 are flat and rectangular with substantially the same width as side members 38 and 40. Wing braces 6 and 8 are hingedly connected to the top surface 62 of top cross member 34 with piano hinges 64 and 66 such that when unfolded their top surfaces 68 and 70, respectively, will be substantially in the same plane as the outside side surfaces 72, 74 of side members 38 and 40 respectively. The bottom edges of each wing brace are cut at a slight angle, preferably an angle of about 3°, such that the wing braces are substantially perpendicular to the top cross member, but angle slightly outwardly the shelf face. As seen in FIGS. 1 and 7, the top edges of each wing brace engage grooves or cleats 35 in the bottom surface, near the front corners, of the central section 13 of the foldable table top 10. In their unfolded position, wing braces 8 and 6 are locked into position substantially perpendicular to top cross member 34 by inserting the top edges of the wing braces into grooves 35 which creates a tension on the wing braces because the braces angle slightly outward. The tension and the frictional engagement of the wing braces in the grooves on the underside of the table top lock the wing braces and table top in their unfolded position. Alternately, wing braces 8 and 6 may be locked into position perpendicular to top cross member 34 by folding knee braces 76 and 78, respectively, which are affixed to the bottom surfaces 80 and 82 of wing braces 6 and 8 and the top surface 62 of top cross member 34. When knee braces 76 and 78 are folded, wing braces 6 and 8 are folded inwardly the shelf face to lie above and parallel to the top surface of top cross member 34.

Foldable table top 10 has central section 13 and side leaves 12 and 14 adjacent thereto. Side sections 12 and 14 are approximately one half the size of central section 13 and are hingedly connected to each side of the central section by piano hinges 90 and 92, respectively, so that the top surfaces 12 and 14 may be folded inwardly and over the central section when the central section is unfolded such that the side edges of the side sections are juxtaposed above the top surface of the central section and the side sections are in a plane above the central section 13 when it is in the unfolded position.

The rear edge 94 of the central section is hinged with piano hinge 96 and connected to the front edge of top panel 22 such that the central section folds out from under the top panel 22. In its folded position the central section is in a plane parallel to the plane formed by the top panel and folds away from such position around piano hinge 96 to its unfolded position which is perpendicular to the top panel and forwardly extending therefrom.

Each side of the container has a snap lock 98 which includes a rectangular ring 100 pivotally mounted on a mount tab 102 which is secured to the outside surface of each side panel, and tongue 104 which is secured to the edge of the top panel opposite the mount tab and ring. The tongue is adapted to engage the ring to frictionally engage the ring and hold the top panel perpendicular to the front and back panels and firmly over the container. Each side panel has a pivotal handle 106, as is known, for carrying the device.

Figure 3:
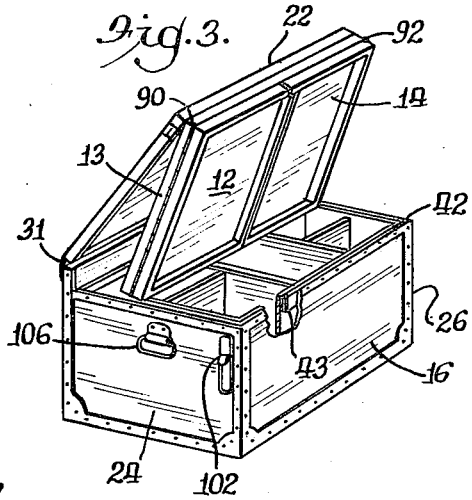
FIG. 3 is a diagrammatic view of the folding table and storage device in its initial stages of being opened.
Figure 5:
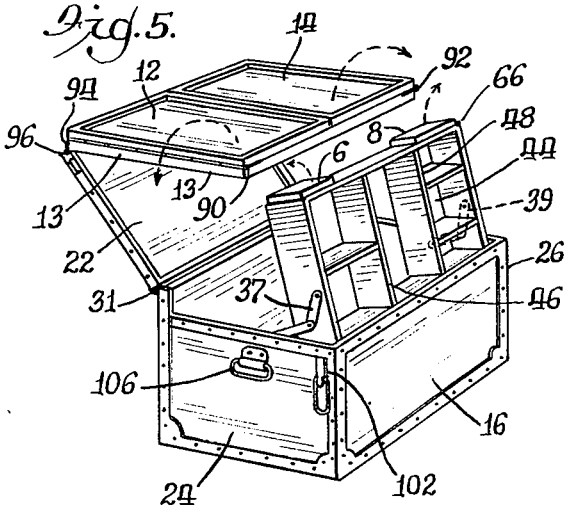
FIG. 5 is a diagrammatic view of the folding table and storage device being opened with a shelf face being put into the vertical position.
Figure 6:
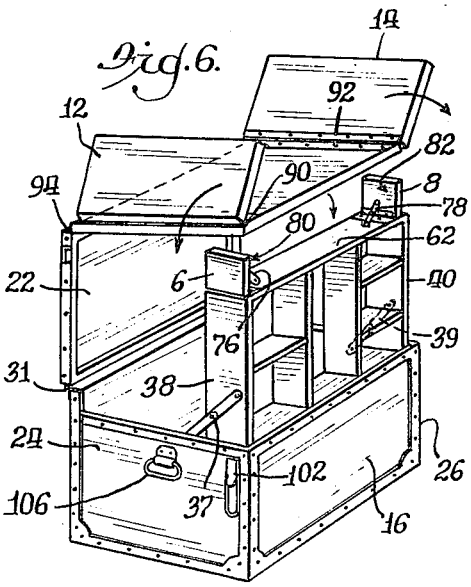
FIG. 6 is a diagrammatic view of the folding table and storage device in the latter stages of being opened.

FIGS. 3 through 6 illustrate the folding table and storage device being opened from a closed folded position. FIG. 3 illustrates the top panel being lifteed around hinge 31 from its closed position which is perpendicular to the front and back panels. As the top panel is lifted, the table top drops from the lower surface of the top panel. Upon further lifting the top panel is placed in the same plane as the back panel. The shelf face is lifted from the container around piano hinge 43 to a vertical position in a plane parallel to and spaced behind the front panel. To lift the shelf face from the container, it is preferable that the top panel be lifted past the vertical and angle outwardly the container, as can be seen in FIG. 5, such that the shelf face may be lifted from the container and pivoted to a vertical position as aforesaid, and knee braces 37 and 39 are locked. The table top then is pivoted around piano hinge 96 away from the lower surface of the top panel such that the table top is perpendicular to the top panel when set to rest upon wing braces as will be hereinafter described. Wing braces 6 and 8 are pivoted around piano hinges 64 and 66, respectively, and are locked substantially perpendicular to top cross member 34 by inserting the top edge of each brace into goovers 35 on the undersurface of central section 13 of the table top. Once locked, as aforesaid, the bottom surface of the central section 13 of the table top is to rest on the upstanding ends of the wing braces, as can be seen in FIG. 6. After the central section of the table top is set to rest on the wing braces, side leaves 12 and 14 of the table top are pivoted around piano hinges 90 and 92 away from the top surface of the central section such that each side leave will be in substantially the same plane as the central section. With the leaves unfolded, side edges of the side leaves abut the side edges of the central section, a table surface being formed by the side leaves and central section, a storage area being provided by the trunk-like base, and shelves being provided on the shelf face.

While the present invention has been shown and described with respect to a specific preferred embodiment thereof, it should be apparent that various modifications, adaptations, and variations may be made utilizing the teachings of the present disclosure without departing from the scope of the following claims.

Various features of the invention are set forth in the following claims.

What is claimed is:

1. A container and foldable support surface comprising:

a container means including a top, bottom, front, back and two side panels;

a shelf face including a means for pivotally connecting said shelf face with said front panel;

a table top including a means for pivotally connecting said table top with said top panel, said table top having a folded closed position and an unfolded open position;

said top panel including a means for pivotally connecting said top panel with said back panel, said top panel pivoting to an open position and acting as a support for said table top in said open position;

said shelf face including a top cross member; a bottom cross member parallel to said top cross member; two parallel side members which are substantially perpendicular to said cross members; two wing braces including a means for pivotally connecting said wing braces with said top cross member, said wing braces pivoting from said closed position where said wing braces are folded inwardly and are substantially parallel to said top cross member, to said open position where said wing braces are unfolded and substantially perpendicular to said top cross member, said wing braces in said unfolded position for the support of said table top;

said shelf face substantially parallel to and spaced from said bottom panel in said folded closed position, said shelf face substantially parallel to said front panel in said open position, said shelf face acting as a means for support for said table top in said open unfolded position; and said table top parallel and interior to said top panel in said folded closed position, and said table top perpendicular to said top panel in said open position.

2. A container and foldable support as recited in claim 1 wherein said table top includes a central section; at least one side leave including a means for pivotally connecting said side leave with said central section; and said side leave having a folded position inward and in a plane substantially parallel to said central section and an unfolded position outward and substantially in the same plane of said central section.

3. A container and foldable support as recited in claim 2 wherein said back panel includes a back wing, said back panel having a height exceeding the height of said front and side panels for folding said side leave of said table top into said closed folded position, folding said table top to said folded closed position, and folding said top panel into folded closed position substantially parallel to said bottom panel and substantially perpendicular to said front and back panel.

* * * * *